United States Patent [19]

Ottinger

[11] Patent Number: 4,803,796

[45] Date of Patent: Feb. 14, 1989

[54] ANIMATED FIGURE

[76] Inventor: Dwight M. Ottinger, 1777 Wren, Corona, Calif. 91719

[21] Appl. No.: 26,061

[22] Filed: Mar. 16, 1987

[51] Int. Cl.[4] ..... G09F 19/08

[52] U.S. Cl. ..... 40/414; 40/423; 40/418

[58] Field of Search ..... 40/414, 423, 418, 411, 40/417, 420, 419; 46/120, 228; 446/361

[56] References Cited

U.S. PATENT DOCUMENTS

| | | | |
|---|---|---|---|
| 1,897,918 | 2/1933 | Wagenhals | 40/423 |
| 2,290,801 | 7/1942 | Dale et al. | 40/414 |
| 2,570,778 | 10/1951 | De Vane | 40/414 |
| 3,168,795 | 2/1965 | Garriss | 40/418 |
| 3,325,759 | 6/1967 | Ito | 40/414 |
| 3,672,097 | 6/1972 | Gardel et al. | 40/418 |

*Primary Examiner*—Gene Mancene

*Assistant Examiner*—Wenceslao J. Contreras

*Attorney, Agent, or Firm*—Beehler, Pavitt, Siegemund, Jagger, Martella & Dawes

[57] ABSTRACT

The invention has reference to an animating mechanism for appendages of a toy figure where different appendages are given different motions. When applied to a winged figure, by way of example, the wings are given an up and down flap-like motion and the arm at the same time is swung laterally back and forth. For power an electric motor drives a rotating eccentric cam wheel. An eccentrically located pivot pin on the wheel has an articulated connection to the wings. At the same time a cam riding around an eccentric cam track on the same wheel causes a vertical rod to rotate, first in one direction and then in the opposite direction, so that the arm attached to the rod swings back and forth in a sidewise direction.

9 Claims, 2 Drawing Sheets

Fig. 4.
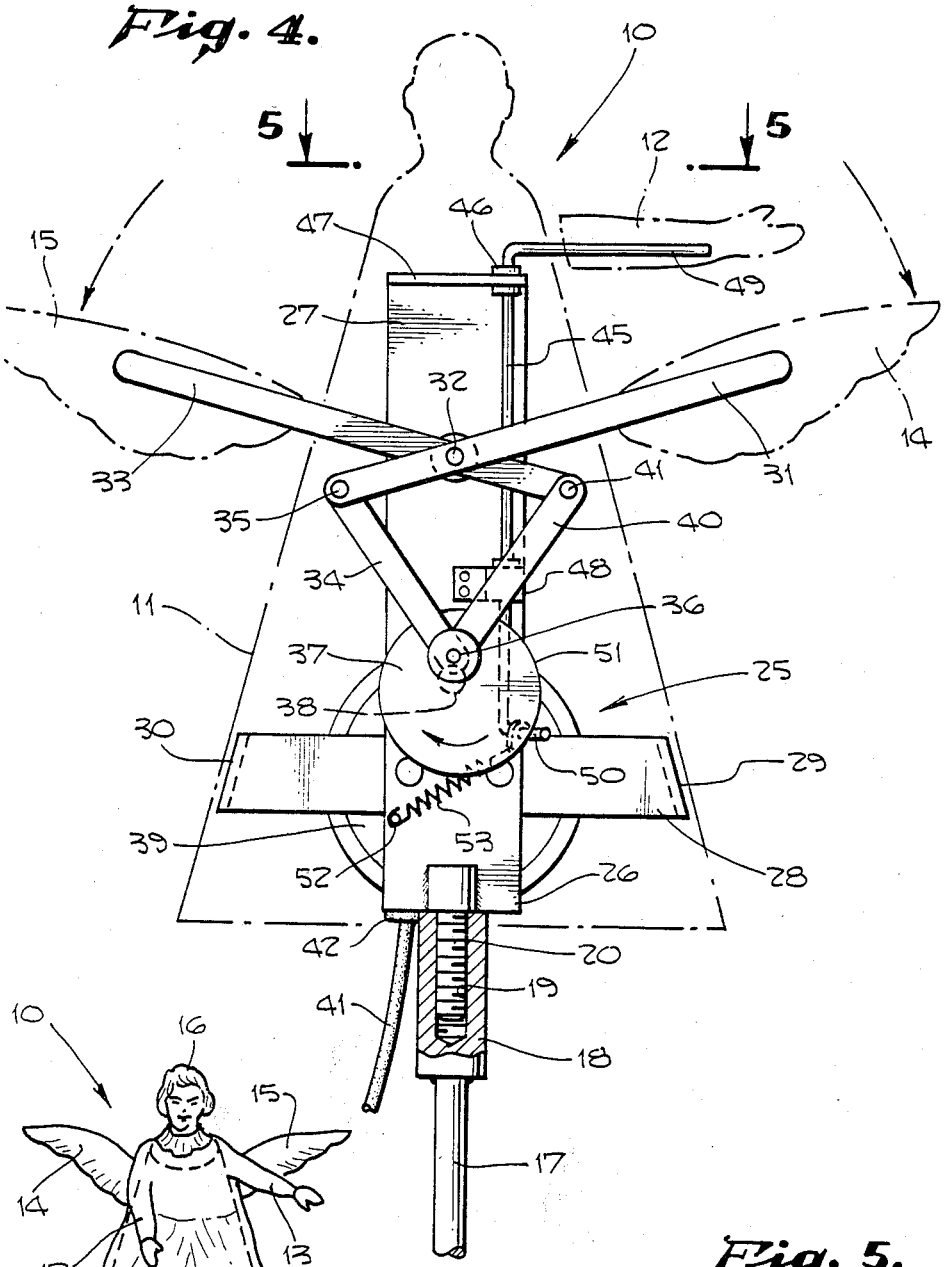
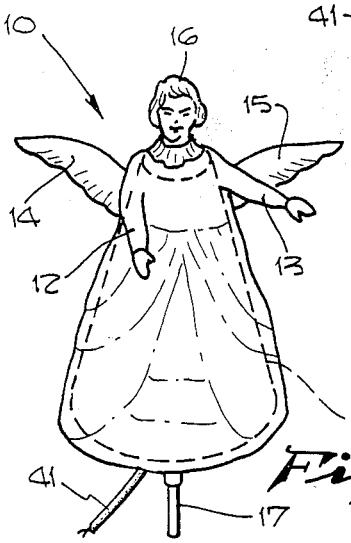
Fig. 1.
Fig. 5.
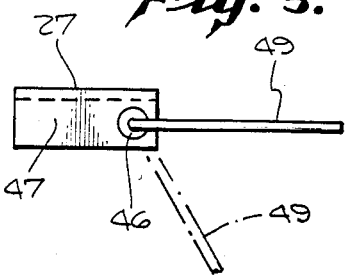

ANIMATED FIGURE

SPECIFICATION

The invention has reference to an animated toy figure equipped with a mechanism sufficiently versatile in its general character so as to be applicable to figures of different kinds with different sorts of appendages. The animating mechanism is especially applicable to toy figures of a decorative character which may perform its functions at a single location and which may have multiple appendages such as arms and wings so attached to the body of the figure that while the wings move in one direction, one or more of the arms may be made to move in a diverse different direction.

The figure, moreover, is one of such construction and appearance, as well as animation, effective in drawing attention to itself. Accordingly, when used in a decorative environment, the figure is one which can be dressed in any one of a variety of modes and which has appendages such as arms and wings which are normally expected to and in fact do have different types of motion, preferably performed simultaneously.

Although ornamental figures capable of being dressed variously and on occasions lighted in various ways to provide a different appeal, such animation as has been provided in the past for figures of such character has been generally limited to no more than a single type of motion for appendages which may be possessed by the figure. On those limited occasions where multiple movements have been resorted to, the tendency has been to supply them with somewhat complex mechanisms not applicable to very simple figure requirements.

It is therefore among the objects of the invention to provide a new and improved figure with multiple animated appendages which is of simple construction and of a dependable mechanism.

Another object of the invention is to provide a new and improved figure with multiple animated appendages capable of being dressed in various manners and which, though adequately animated, is relatively light in weight so that the weight is not an impediment to its use in different environments.

Another object of the invention is to provide a new and improved figure with multiple animated appendages with a mechanism adaptable to toy figures, whether of human or animal kind, and with different types of appendages which may advantageously be moved individually in different directions.

Still another object of the invention is to provide a new and improved figure with multiple animated appendages, the animating mechanism of which is of a dependable type but at the same time light in weight and sufficiently compact to be contained within the body portion of the figure without need for distorting the figure effect, the body in consequence being one which can be varied appreciably, depending upon what the nature of the figure is which is being depicted.

Also included among the objects of the invention is to provide a new and improved figure with multiple animated appendages wherein the mechanism is such that movement of the appendages can be varied both as to degree and direction by relatively simple changes in the location and arrangement of the moving parts.

With these and other objects in view, the invention consists of the construction, arrangements, and combination of the various parts of the device serving as an example only of one or more embodiments of the invention, whereby the objects contemplated are attained, as hereinafter disclosed in the specification and drawings and pointed out in the appended claims.

IN THE DRAWINGS:

FIG. 1 is a front elevational view of one form of animated figure to which the animation mechanism is applicable.

FIG. 4 is a longitudinal sectional view similar to FIG. 3 with the parts in a different position.

FIG. 5 is a fragmentary cross-sectional view on the line 5—5 of FIG. 4.

Figure 3:
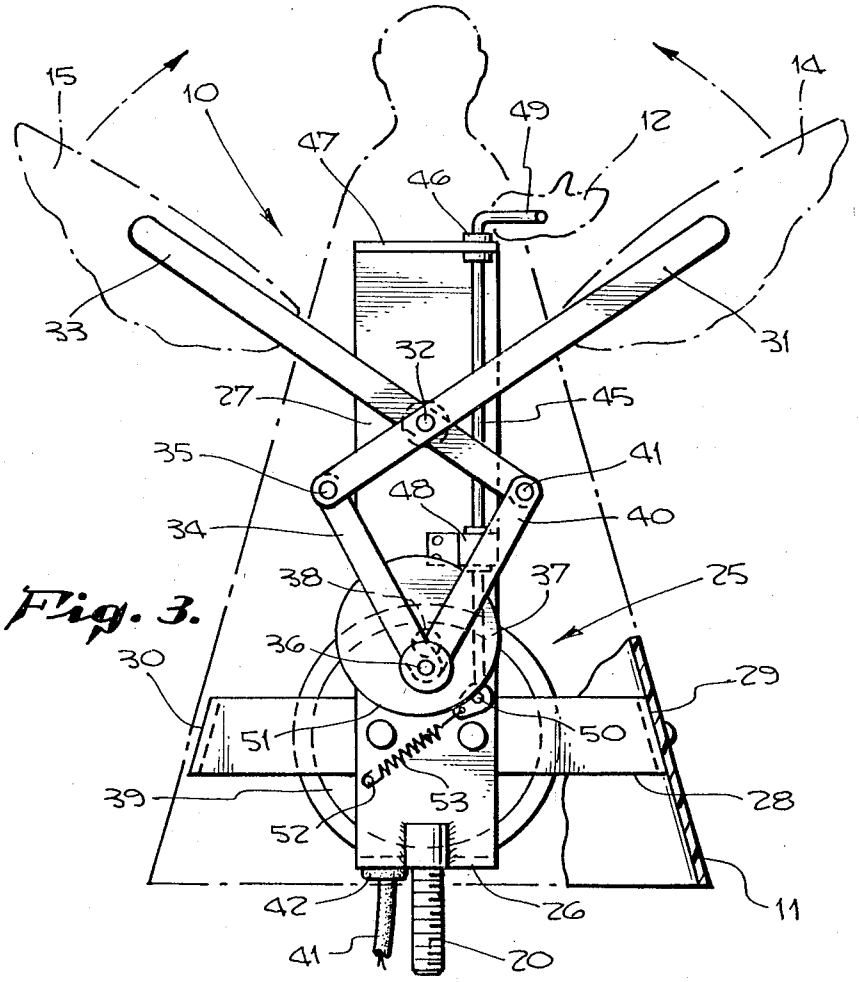
FIG. 3 is a longitudinal sectional view of the mechanism as viewed from the rear with the mechanism in one position of operation.
Figure 2:
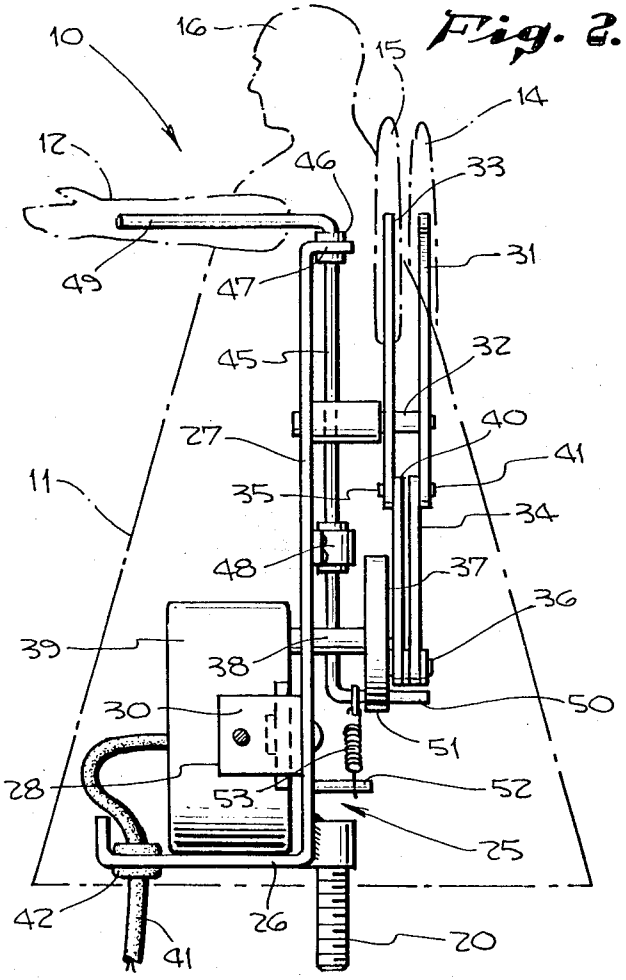
FIG. 2 is a longitudinal sectional view of the mechanism from one side.

In one embodiment of the invention chosen for the purpose of illustration a FIG. 10 has been depicted as that of an angel having a body 11, arms 12, 13, wings 14, 15 and a head 16. The figure which chanced to be chosen is that of an ornament capable of being mounted on the top of a post or tree by use of a mounting rod 17, at the upper end of which is a cup 18 provided with a cylindrical threaded chamber 19. The chamber is adapted to receive an exteriorly threaded mounting shaft 20 extending downwardly from the body. It should be appreciated in this connection that the mounting described is primarily adapted to the support of an erect figure. For the mounting of the same figure in a different position or for the mounting of a figure of some different character as, for example, a four-legged animal, some different form of mounting would be preferable.

To support the erect FIG. 10 of the chosen embodiment there has been provided a frame 25 having a base 26 from which an appendage support section 27 extends upwardly. Projecting laterally outwardly from the appendage support section is a bracket 28, outer ends 29 and 30 of which are adapted to carry the somewhat conically shaped body 11. The mounting shaft 20 previously identified is shown with a welded attachment to the lower end of the appendage support section 27.

As shown advantageously in FIG. 4, one wing 14 is carried by the outer end of a shaft 31, the shaft 31 having a pivotal mounting on the upper portion of the appendage support section 27, there being provided for this purpose a pivot pin 32, for ease in illustration. For the other wing 15 there is a similar shaft 33 adapted to be supported by the same pivot pin 32. In order to give controlled movement ot the wing 14, there is provided a link 34 with a pivot attachment 35 at its upper end to a corresponding adjacent end of the shaft 31.

For the opposite end of the link 34 there is a pivotal mounting 36 of the link on a pivot member in the form of a wheel 37. The pivotal mounting is eccentric with relation to the location of a drive shaft 38 from an electric motor 39 on the base 26.

Pivoting rivet connections may be substituted for the pivot pin 32, pivot attachments like that of the attachment 35 and the pivotal mounting 36, if desired.

The shaft 33 of the wing 15 is similarly equipped with a link 40 attached by means of a pivot attachment 41 to the corresponding end of the shaft 33, the opposite end of the link 40 being attached by the pivotal mounting 36 to the wheel 37.

It should be clear from the foregoing description that when the motor 39 activates its drive shaft 38 to rotate the wheel 37, the pivotal mounting 36 will move up and down about the axis of rotation of the drive shaft 38, causing corresponding ends of the links 34 and 40 to move up and down with these in turn swinging the upper ends of the respective shafts 31 and 33 up and down through a longer arc to, in effect, flap the wings 14 and 15.

The motor, which is the source of movement for not only the wings but also one of the arms 12, is supplied with electric power through a cord 41, the cord being one extending through a strain release connection 42 on the base 26.

The arm 12 as an appendage to the figure differing from the wings 14 and 15 is afforded an entirely different type of motion, although supplied with power by the same motor 39. In the chosen embodiment only one of the arms is mechanized. For supporting and moving the arm 12, there is provided a vertically extending rod 45 having an upper journal support 46 on a bracket 47 at the upper end of the appendage support section 27. There is also a lower journal support 48 at a lower location on the same appendage support section 27. Journalled as shown, the rod 45 is adapted to rotate about its longitudinal axis as a center of rotation. As a consequence, a laterally extending rod arm 49 at the upper end of the rod 45 on which the arm 12 is mounted is enabled to swing to and fro in response to rotation of the vertically extending rod 45.

To provide the rotation described, there is a similar rod arm 50 at the lowermost end of the rod 45. The rod arm 50 projects outwardly far enough to engage the perimetrical surface of the wheel 37 which acts as a cam track 51. In order to maintain the rod arm 50 in engagement with the cam track, there is provided a coil spring 53, one end of which is attached to the rod arm 50 and the other end of which is attached to a projecting bracket 52 which extends rearwardly from the lower portion of the appendage support section 27.

It follows from the arrangement just described that when the motor 39 is activated with its drive shaft 38 rotating the wheel 37, and with the cam track 51 eccentrically positioned with respect to the drive shaft 38, the rod arm 50 will be moved back and forth by action against it of the cam track 51, in this way to rotate the vertically extending rod 45 about its longitudinal axis and consequently to swing the rod arm 49 and the arm 12 of the figure to and fro. The to and fro motion takes place at the same time that the flap-like motion of the wings is also taking place, powered by the identical drive shaft 38 and wheel 37.

Should it be deemed advantageous, the head 16 of the figure can also be structured to move, either from side to side or nodding up and down. The source of motion can be either that of the arm or that of the wings. Both arm and leg motion can be applied to a four-legged subject if desired.

It should be further appreciated that inasmuch as the wheel 37 is the source of two entirely different motions, the same mechanism could as readily be used to activate appendages of other sorts on a chosen toy figure in a manner operating either one or both of two pairs of appendages, by way of example. Since other parts of the body might be afforded movement, resort could also be had to motion of the head, or merely motion of portions of the body only, should that be the desire.

Employment of shafts 31, 33 for the wings and a rod for the arm 49 has the further advantage of providing mounts for lamp holders on those occasions where a lighted device is preferred.

While a particular embodiment of the present invention has been shown and described, it will be obvious to those skilled in the art that changes and modifications may be made without departing from the invention in its broader aspects and, therefore, the aims of its appended claims are to cover all such changes and modifications as fall within the true spirit and scope of this invention.

Having described the invention, what is claimed as new in support of Letters Patent is as follows:

1. An animating mechanism for a figure in the form of a body having multiple movable appendages with paths of movement in diverse directions relative to the body and to each other, said mechanism comprising a frame having a base member with an appendage support section on said base member, a motor on the frame having a drive shaft, a rotating member non-rotatably mounted on and carried by the drive shaft, a pivot member eccentrically mounted on the rotating member at a first radial location on said rotating member, a first appendage means having a pivotal mounting on the support section, said first appendage means having an appendage carrying end on one side of the pivotal mounting, and a link connecting the other end of the first appendage means with the pivot member, a second appendage means comprising a rod rotatably mounted on the support section, said second appendage means having an appendage carrying end and a cam on the end remote from the appendage end, and an eccentric cam track on said rotating member at a second radial location on said rotating member operably receptive of the cam whereby to rotate said rod and the appendage carrying end of the rod.

2. An animating mechanism as in claim 1 wherein there are two of said first appendage means and a link connecting the other end of each said first appendage means with the pivotal mounting at the same location.

3. An animating mechanism as in claim 2 wherein there is a simulated wing member on the appendage carrying end of each of said first appendage means.

4. An animating mechanism as in claim 1 wherein there is a chamber within said body wherein said motor, said base, said support section and said appendage means are mounted.

5. An animating mechanism as in claim 1 wherein said second appendage means comprises upper and lower journal mounts for said rod element, a transversely extending first portion of said rod element at an outer end comprising said second appendage carrying end.

6. An animating mechanism as in claim 5 wherein there is a transversely extending second portion of said rod element at an inner end, said cam being mounted on said inner end.

7. An animating mechanism as in claim 1 wherein there is a resilient retention member acting between said second appendage means and said body in a direction for urging said cam into engagement with said cam track.

8. An animating mechanism as in claim 7 wherein said resilient retention member is a coiled spring.

9. An animating mechanism as in claim 1 wherein said first and second appendage means have respective engagements with said rotating member at locations of different eccentricity.

* * * * *